US007311547B2

(12) United States Patent
Takano et al.

(10) Patent No.: US 7,311,547 B2
(45) Date of Patent: Dec. 25, 2007

(54) CONNECTOR FOR CABLE

(75) Inventors: Hirohisa Takano, Kanagawa (JP); Tomoyuki Satoh, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/497,660

(22) Filed: Aug. 1, 2006

(65) Prior Publication Data

US 2007/0032134 A1 Feb. 8, 2007

(30) Foreign Application Priority Data

Aug. 2, 2005 (JP) ..... 2005-224235

(51) Int. Cl.
*H01R 12/24* (2006.01)

(52) U.S. Cl. ..... 439/495

(58) Field of Classification Search ..... 439/495, 439/260, 492, 342, 74, 67, 77, 493, 494
See application file for complete search history.

(56) References Cited

U.S. PATENT DOCUMENTS 4,978,315 A * 12/1990 Edgley et al. ..... 439/441
5,076,803 A 12/1991 Mutarelli et al.
5,695,359 A 12/1997 Fujikura et al.
6,210,209 B1 4/2001 Wu et al.

* cited by examiner

*Primary Examiner*—Javaid H. Nasri
(74) *Attorney, Agent, or Firm*—McCormick, Paulding & Huber LLP

(57) ABSTRACT

A cable connector having a receptacle connector, the receptacle connector includes a receptacle body which is made of an insulating material and into which a cable is inserted; a plurality of contacts which are provided in the receptacle body; a spacing member which separates the cable inserted into the receptacle body from the contacts by an elastic force of the spacing member to thereby provide an electrically disconnected state; and a biasing member which biases the cable toward the contacts against an elastic force of the spacing member. A movement restricting portion which restricts the movement of the cable toward the contacts so that the cable is brought into conductive contact with the contacts by the biasing force of the biasing member only when the cable is inserted to the predetermined position in the receptacle body.

6 Claims, 11 Drawing Sheets

CONNECTOR FOR CABLE

CROSS REFERENCE TO RELATED APPLICATION

The present invention is related to and claims priority of the following pending application, namely, Japanese Patent Application No. 2005-224235 filed on Aug. 2, 2005.

BACKGROUND OF THE INVENTION

1. Field of the Invention

The present invention relates to a cable connector for holding a flexible printed circuit (FPC), a flexible flat cable (FFC), or other flat and flexible cables.

2. Description of the Related Art

Most conventional cable connectors for holding a flat and flexible cable include an insulating housing into which a cable is inserted, a plurality of contacts placed inside the insulating housing, a pressing member for pressing the inserted cable against the contacts, and an actuator having a cam portion for moving the pressing member (see, for example, Japanese Patent Application Laid-Open No. 2004-87361).

However, in such conventional cable connectors, a continuity test after insertion of the cable into a receptacle body may give a result that indicates electrical continuity between the cable and the contacts in the following cases: if the closing operation of the actuator is omitted even though the cable has been inserted into the receptacle body; if the insertion of the cable or the closing operation of the actuator is incomplete; or even in the case where the cable is connected to non-target contacts to cause unexpected electrical continuity. In such conditions, the cable may disconnect from the receptacle body upon shipment, often causing continuity failure in spite of the fact that test results have initially indicated electrical continuity. Furthermore, even when the cable is correctly inserted and the closing operation of the actuator is performed, the electrical continuity between the contacts and the cable may not be maintained if an external force is accidentally applied to the actuator during, for example, an application assembly process, shipping, or during other processes.

Moreover, if the cable is inserted into the receptacle body while an application is in an energized state, it is difficult to reliably maintain an electrically disconnected state since the cable is not securely held in place before the closing operation of the actuator is performed. If an electrically disconnected state were not to be maintained, and only part of the signal line is brought into conductive contact or a touch (instantaneous conduction) occurs, a short circuit in the application or fracture of a protection circuit, or the like, may occur in the worst case scenario, causing a malfunction.

SUMMARY OF THE INVENTION

According to an aspect of the present invention, a cable connector having a receptacle connector is provided, the receptacle connector including a receptacle body which is made of an insulating material and into which a cable is inserted; a plurality of contacts which are provided in the receptacle body; a spacing member which separates the cable inserted into the receptacle body from the contacts by an elastic force of the spacing member to thereby provide an electrically disconnected state; and a biasing member which biases the cable toward the contacts against an elastic force of the spacing member. A movement restricting portion which restricts the movement of the cable toward the contacts so that the cable is brought into conductive contact with the contacts by the biasing force of the biasing member only when the cable is inserted to the predetermined position in the receptacle body.

It is desirable for the cable connector to include a holder for holding the cable when the cable is inserted into the receptacle body.

It is desirable for the biasing member to include an actuator which is rotatably held by the holder. The actuator includes a cam portion which is rotatably movable when the holder is inserted into the receptacle body. The actuator biases the cable toward the contacts by the rotational movement of the cam portion against the elastic force of the spacing member.

It is desirable for the spacing member to include a spring which is supported by the receptacle body so as to be elastically deformable in a direction in which the cable, inserted into the receptacle body, opposes the contacts. The spacing member separates the cable from the contacts by the elastic force of the spacing member when the biasing force of the biasing member is not exerted on the cable.

It is desirable for the cable connector to include a movement restricting device including the movement restricting portion provided on the receptacle body and a projecting portion provided on the holder so as to project outward from a side surface thereof. The movement restricting portion includes a recessed accommodating portion which accommodates the projecting portion therein by the biasing force of the biasing member when the cable is inserted to the predetermined position in the receptacle body whereby the cable is brought into contact with the contacts; and an accommodation maintaining portion which maintains a state in which the projecting portion is accommodated in the recessed accommodating portion.

It is desirable for the biasing member to include an actuator which is rotatably held by the holder. The actuator includes a cam portion which is rotatably movable when the holder is inserted into the receptacle body. The actuator biases the cable toward the contacts by the rotational movement of the cam portion against the elastic force of the spacing member. Upon the cam portion of the actuator being rotationally moved in a direction so as to bias the cable toward the contacting portion in a state where the cam portion is positioned between a contacting portion of the contacts and a stabilizer leg, which are arranged so as to be opposed to each other, the accommodation maintaining portion maintains a state in which the projecting portion is accommodated in the recessed accommodating portion by bringing two opposing end surfaces of a planar portion provided in the cam portion into abutment with the rear surface of the cable and the stabilizer leg, respectively, to thereby align the contacting portion, abutment surfaces of the cable, the planar portion, and an abutment surface of the stabilizer leg in one line of force.

According to the present invention, a cable connector can be provided in which an electrically disconnected state between a cable and contacts can be maintained if the insertion of the cable into a receptacle body is incomplete, if a closing operation of an actuator is incomplete, or if a fit state is incomplete, i.e., the cable is connected to non-target contacts to cause unexpected electrical continuity. Additionally, this cable connector can prevent unexpected disconnection of the cable. Furthermore, since the cable is inserted into the receptacle body with the cable held by a holder while the position of the cable is restricted, an electrically disconnected state between the contacts and the cable can be reliably maintained during the insertion.

BRIEF DESCRIPTION OF THE DRAWINGS

The present invention will be discussed below in detail with reference to the accompanying drawings, in which.

DETAILED DESCRIPTION OF PREFERRED EMBODIMENTS

Figure 1A:
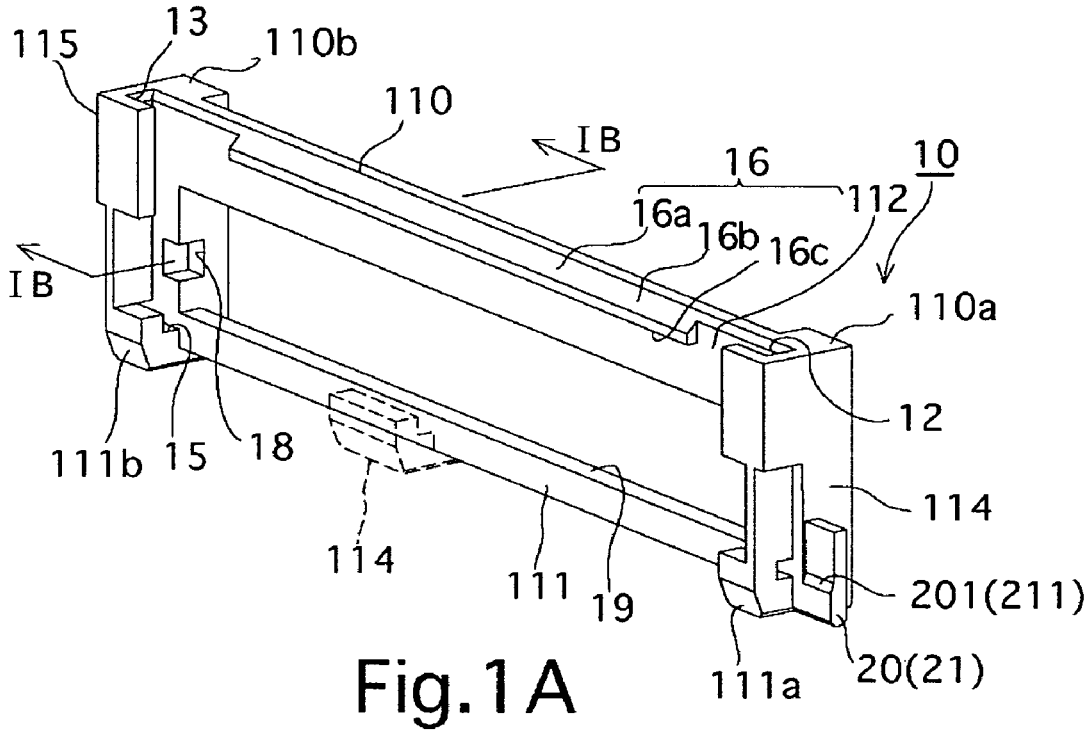
FIG. 1A is a perspective view illustrating the configuration of a holder according to an embodiment of the present invention.
Figure 3A:
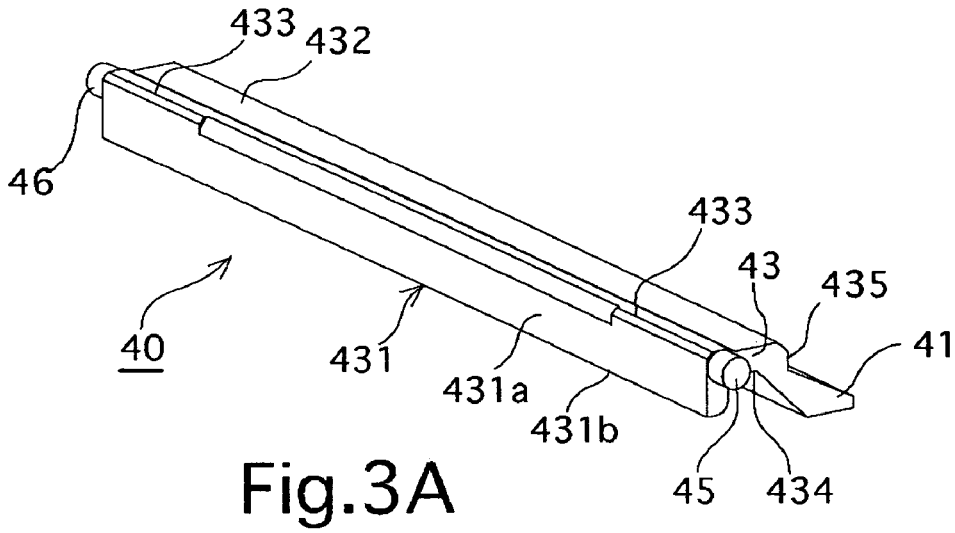
FIG. 3A is a perspective view illustrating the configuration of an actuator according to the embodiment of the present invention.
Figure 3B:
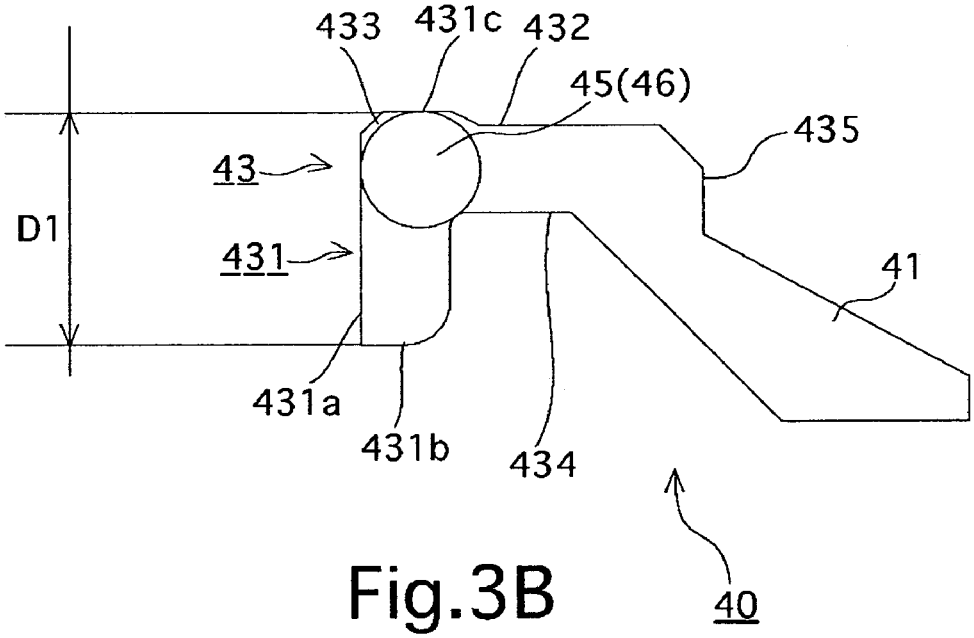
FIG. 3B is a side view of the actuator shown in FIG. 3A.

Hereinafter, an embodiment of the present invention will be described in detail with reference to the drawings. The cable connector according to the present embodiment includes a holder 10 (FIG. 1A), a receptacle body 60 (FIGS. 4A through 4D), contacts 80 (FIG. 5), auxiliary springs 91 and 92 (FIG. 6) serving as a spacing member, and a receptacle connector 50 (FIGS. 4A through 4D) provided with an actuator 40 (FIGS. 3A and 3B).

(1) Holder 10

The holder 10 is an insulating member and is inserted into the receptacle connector 50 with a cable 30 held inside the holder 10. The holder 10 includes cable insertion portions 12 through 15, a cable holding portion 16, actuator holding portions 17 and 18, an accommodating portion 19, and fitting keys (projecting portions) 20 and 21. The holder 10 is formed by injection molding an insulating material (such as 9T nylon, 66 nylon, 46 nylon, other nylon (PA), a liquid crystal polymer (LCP), or polyphenylene sulfide (PPS)).

Figure 1B:
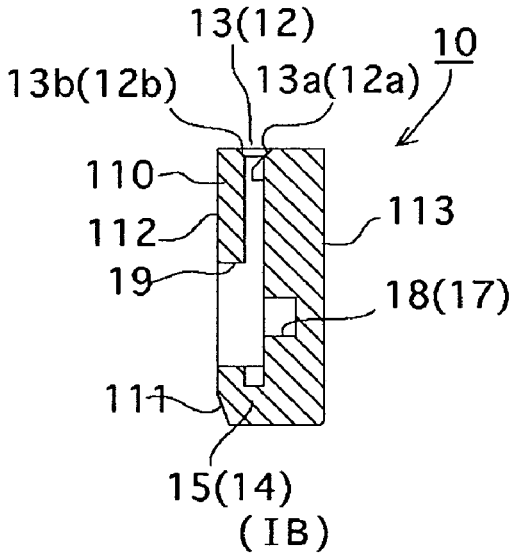
FIG. 1B is a cross-sectional view taken along the line IB-IB in FIG. 1A.

The cable insertion portions 12 and 13 are provided in respective two widthwise end-portions 110*a* and 110*b* of an upper portion 110 of the holder 10 having an approximately rectangular shape and are formed into a groove shape which opens inwardly. The distance between the cable insertion portions 12 and 13 is substantially the same as the width of the cable 30 to be inserted therebetween (the direction orthogonal to the insertion direction of the cable into the cable insertion portion 12). As shown in FIG. 1B, inclined surfaces 12*a* and 12*b* for guiding the cable 30 are provided in the upper portion of the inner surface of the cable insertion portion 12. The inclined surfaces 12*a* and 12*b* incline towards each other in the insertion direction of the cable 30. Inclined surfaces 13*a* and 13*b* are provided in the inner surface of the cable insertion portion 13, similar to the inclined surfaces 12*a* and 12*b*.

The cable insertion portions 14 and 15 are provided at two widthwise end-portions 111*a* and 111*b* of a lower portion 111 of the holder 10 at respective positions corresponding to the cable insertion portions 12 and 13, and are formed into a groove shape which opens inwardly. The cable 30 is inserted into the holder 10 from above with two widthwise side portions contacting the two end portions 110*a* and 110*b*, respectively. When the two end portions of a lower surface 33 of the cable 30 abut the cable insertion portions 14 and 15, respectively, the insertion is completed. The shape of the cable insertion portions 12 through 15 are not limited to grooves so long as the cable 30 can be inserted into the holder 10. Furthermore, a side portion 114 (shown by a dotted line in FIG. 1A) having a groove profile similar to that of the cable insertion portions 14 and 15 can be provided midway between the cable insertion portions 14 and 15 in the width direction of the holder 10. In this manner, sag of the cable 30 can be advantageously prevented.

The cable holding portion 16 includes an inclined surface 16*a*, a flat surface 16*b*, and a lower surface 16*c*. The inclined surface 16*a* is inclined obliquely downward from the upper portion 110 of the holder 10 in an insertion direction of the cable 30. The insertion position of the cable 30 is determined by the cable insertion portions 12 through 15. The flat surface 16*b* is formed in the end portion of the inclined surface 16*a* so as to extend in the vertical direction, and the lower surface 16*c* extends from the flat surface 16*b* in an approximately horizontal direction.

The actuator holding portion 17 is provided between the end portion 110*a* and the end portion 111*a*, and the actuator holding portion 18 is provided between the end portion 10*b* and the end portion 111*b*. These actuator holding portions 17 and 18 are recessed so as to rotatably support supporting members 45 and 46 (to be described later), respectively, of the actuator 40. The actuator holding portions 17 and 18 are provided at respective positions so as not to interfere with the insertion of the cable 30 into the holder 10 when the actuator 40 is held in an open state.

Figure 1C:
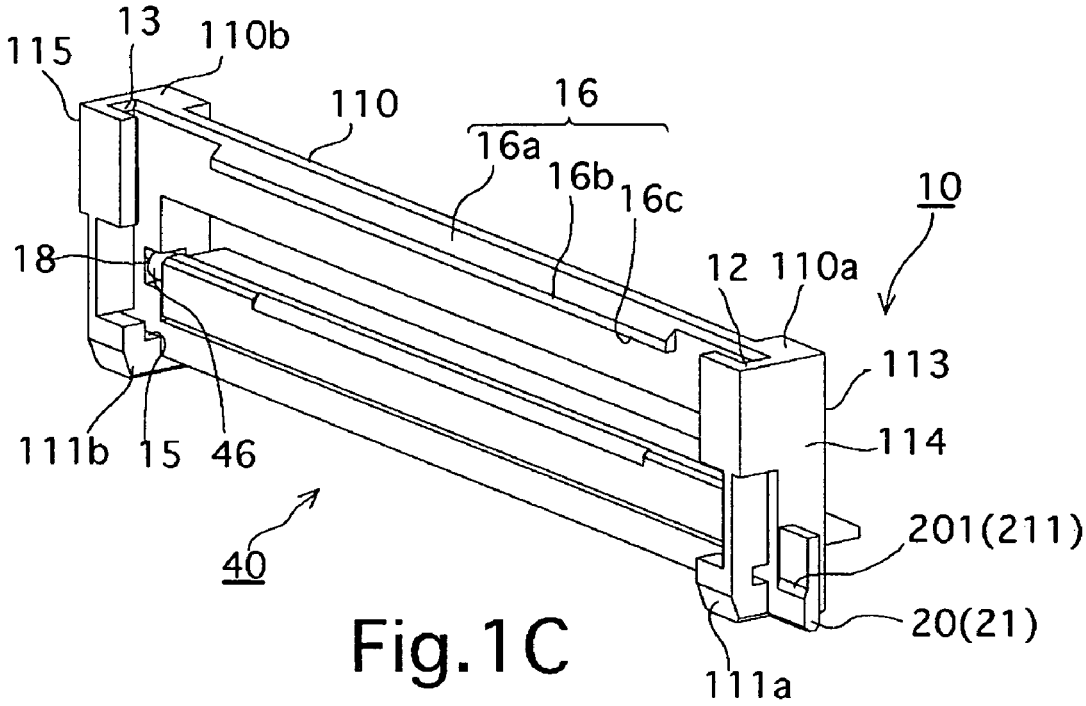
FIG. 1C is a perspective view illustrating the state in which an actuator is mounted on the holder.

The accommodating portion 19 is provided in a cut-out area at the center of, and extends through the holder 10 in the thickness direction thereof (the direction from a front surface 112 to a rear surface 113). The actuator 40 is inserted into the accommodating portion 19 from the front surface 112. The supporting members 45 and 46 of the actuator 40 are rotatably supported by the actuator holding portions 17 and 18, respectively, and the actuator 40 projects from the rear surface 113 (FIG. 1C).

Figure 1D:
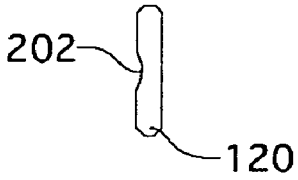
FIG. 1D is a side view illustrating the configuration of a fitting key of a modified example.

The fitting keys (projecting portions/movement restricting members) 20 and 21 having an approximately rectangular parallelepiped shape are provided in the lower portions of side surfaces 114 and 115, respectively, of the holder 10 so as to project outward widthwise. The fitting keys 20 and 21 are accommodated in respective key grooves provided at predetermined positions in the aforementioned receptacle body 60 (see FIGS. 4A through 4D) when the holder 10 is inserted into the receptacle body 60. Furthermore, the fitting keys 20 and 21 define the insertion depth of the holder 10 into the receptacle body 60 and prevent the holder 10 from disconnecting (coming out) from the receptacle body 60. In addition, step portions 201 and 211 are provided in the fitting keys 20 and 21, respectively, near the central portion in the height direction. Hence, when the holder 10 is inserted into the receptacle body 60, a click can be felt with the aid of the elastic force of the auxiliary springs 91 and 92 which are provided in the receptacle body 60. Instead of the fitting keys 20 and 21, fitting keys 120 shown in FIG. 1D may be employed which have a configuration provided with a recess 202 near the central portion in the height direction. In this case, advantageously, a click can be felt more definitely, and bent abutment portions 915*a* and 925*a* (see FIG. 6) of the auxiliary springs 91 and 92 are fitted into the recess 202 to temporarily hold the holder 10.

Figure 2A:
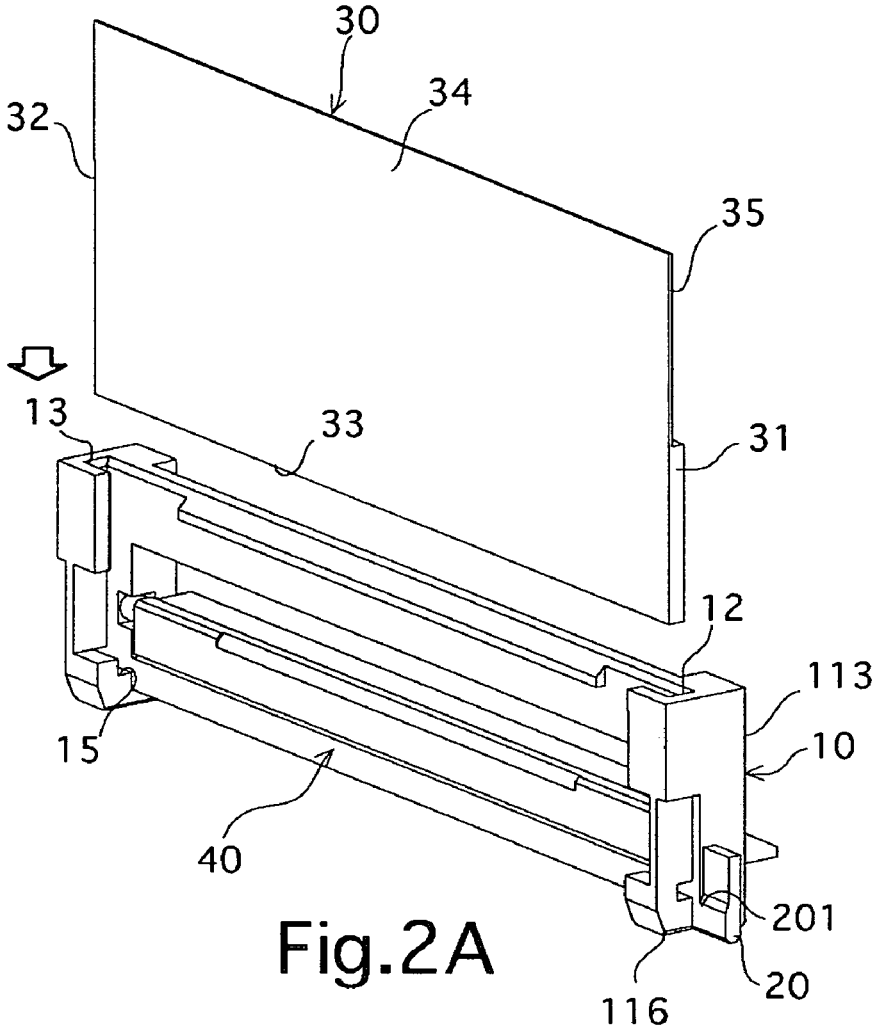
FIG. 2A is a perspective view illustrating the state in which a cable is inserted into the holder of FIG. 1C.
Figure 2B:
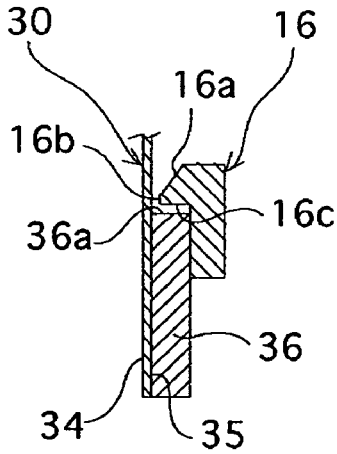
FIG. 2B is a vertical cross-sectional view illustrating the state in which the cable is opposed to a cable holding portion.

The cable 30 may be a flexible printed circuit (FPC) or a flexible flat cable (FFC), or have another well-known flat and flexible structure (FIGS. 2A and 2B). On a surface 34 of the cable 30, a conductor portion (not shown) is formed which is brought into conductive contact with the contacts placed in the receptacle body 60. On a rear surface 35 of the cable 30, a reinforcing plate 36 is adhered and fixed to the edge portion which is inserted into the receptacle body 60. The reinforcing plate 36 may be formed of, for example, a polyimide, PET (polyethylene terephthalate), glass epoxy, or stainless steel (SUS).

(2) Actuator 40

Figure 2C:
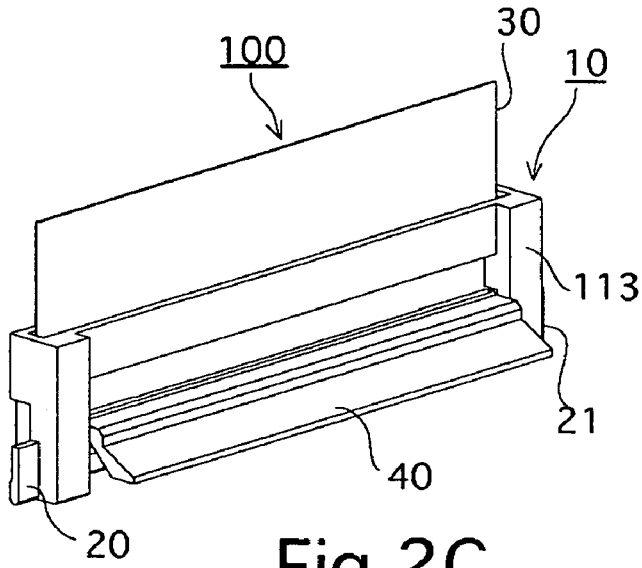
FIG. 2C is a perspective view as viewed from the rear side of the holder illustrating the configuration of a holder unit after the cable is inserted.
Figure 2D:
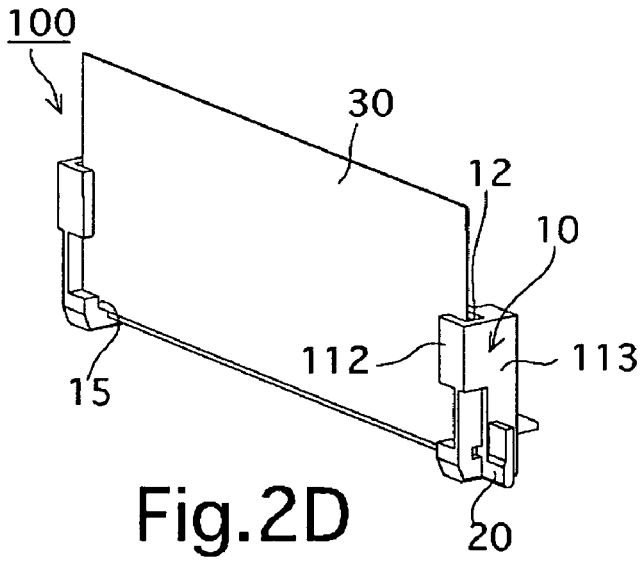
FIG. 2D is a perspective view as viewed from the front side of the holder shown in FIG. 2C.
Figure 2E:
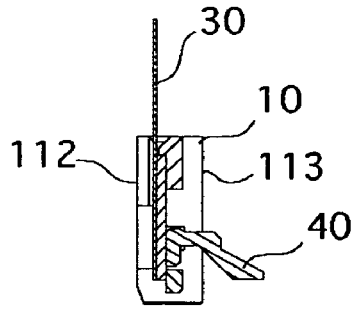
FIG. 2E is a vertical cross-sectional view of the holder of FIG. 2C near the central portion in the lengthwise direction.

The actuator (biasing member) 40 shown in FIGS. 3A and 3B is a plate shape member having a approximately L-shaped cross-section on a plane perpendicular to the lengthwise direction. The actuator 40 includes an operation portion 41 for performing an opening-closing action when the actuator is held in the holder 10, a cam portion 43, and the supporting members 45 and 46 having an approximately cylindrical shape. As shown in FIGS. 2C and 2D, the actuator 40, the cable 30, and the holder 10 constitute a holder unit 100. The cam portion 43 includes a stabilizer portion 431 having a long plate-like shape, a planar connection portion 432 extending from the stabilizer portion 431 in the direction approximately perpendicular to the width direction thereof, and a recessed portion 434 which is provided by connecting the planar connection portion 432 and the operation portion 41 through a step portion 435. The recessed portion 434 is formed so as to be surrounded by the stabilizer portion 431, the planar connection portion 432, and the operation portion 41, and is engaged with a rotational movement supporting portion of the contacts 80 in the receptacle body 60 during the opening-closing action of the actuator 40. The stabilizer portion 431 includes a planar surface 431*a* which holds the cable 30 when the actuator 40 is in an opened state, an end surface 431*b*, and a receiving surface 431*c*, the end surface 431*b* and the receiving surface 431*c* being provided on opposite sides to each other extending in the width direction thereof. The end surface 431*b* has a planar portion which abuts on recessed portions 87*a* and 87*a*' of stabilizer legs 87 and 87' when the actuator 40 is in a closed state. The receiving surface 431*c* has a planar portion which receives contact pressure of a spring portion 85 of the contact 80 through the cable 30.

Furthermore, thick portions 433 are formed in the both lengthwise end portions of a portion connecting the stabilizer portion 431 with the planar connection portion 432 so as to protrude outwardly (FIGS. 3A and 3B). The thick portions 433 abut on the reinforcing plate 36 when the actuator 40 is operated, and a click can be felt when the reinforcing plate 36 passes the thick portions 433. The positions of the thick portions 433 are not limited to both the lengthwise end portions; the thick portions 433 can be formed at any position in order to obtain a desired click feeling strength and a desired operational feel. The stabilizer portion 431 has a distance D1 between the end surface 431*b* and the receiving surface 431*c* in order for a contacting portion 88 to undergo predetermined displacement when the actuator 40 is in a closed state. The distance D1 may be set to a suitable fixed value such that a desired locking force is obtained when the actuator 40 is in a closed state. Specifically, the distance D1 may be set in consideration of the elasticity and the shape (particularly, the distance between the contacting portion 88 and the stabilizer leg 87) of the contact 80 and the elasticity and the thickness of the cable 30.

The supporting members 45 and 46 having an approximately cylindrical shape project outwardly from the side surface of the boundary portion between the stabilizer portion 431 and the planar connection portion 432. Furthermore, these supporting members 45 and 46 are engaged with the actuator holding portions 17 and 18, respectively, of the holder 10 and serve as the axis for the opening-closing operation of the actuator 40. Likewise with the holder 10, the actuator 40 is formed by injection molding an insulating material (such as 9T nylon, 66 nylon, 46 nylon, other nylon (PA), a liquid crystal polymer (LCP), or polyphenylene sulfide (PPS))

Furthermore, the actuator 40 may be held by the receptacle body 60 instead of the holder 10. In this case, if the reinforcing plate 36 has a stiffness large enough to allow the cable 30 to move by the action of the actuator 40, the holder 10 does not need to be employed.

(3) Assembly of the Holder Unit 100

The assembly of the holder unit 100 (i.e., the assembly of the holder 10 and the actuator 40 and the insertion of the cable 30 into the holder 10) is performed as follows.

First, the actuator 40 is inserted into the accommodating portion 19 from the side on which the cable is placed in the holder 10 (the side on which the cable insertion portions 12 through 15 are provided). The operation portion 41 is inserted first, and the supporting members 45 and 46 are engaged with the actuator holding portions 17 and 18, respectively (FIG. 1C).

Figure 1E:
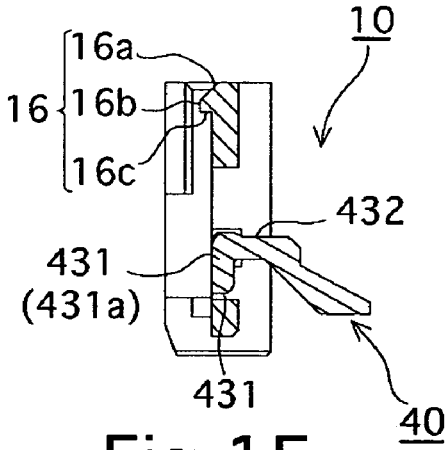
FIG. 1E is a vertical cross-sectional view of the holder of FIG. 1C near the central portion in the lengthwise direction.

Subsequently, the actuator 40 is held in an opened position (the state in which the actuator 40 has been rotationally moved such that the planar surface 431*a* of the stabilizer portion 431 is positioned along an approximately vertical direction, i.e., the state shown in FIG. 1E). While the actuator 40 is maintained in the opened position, the cable 30 is inserted into the cable insertion portions 12 and 13 from above, such that the reinforcing plate 36 is arranged on the actuator 40 side. Thereafter, the reinforcing plate 36 of the cable 30 slides onto the cable holding portion 16 with the two side surfaces 31 and 32 of the cable 30 positioned by the cable insertion portions 12 and 13, respectively, i.e., the cable 30 is inserted while being bent. After the reinforcing plate 36 passes the flat surface 16*b* of the cable holding portion 16, the planar shape is resumed due to the elasticity of the reinforcing plate 36. Furthermore, the planar surface 431*a* of the stabilizer portion 431 of the actuator 40 abuts against the reinforcing plate 36 of the cable 30, and the reinforcing plate 36 is fitted into the cable insertion portions 14 and 15, whereby the actuator 40 is held in the open position by the elasticity of the cable 30. Moreover, since an upper surface 36*a* of the reinforcing plate 36 opposes the lower surface 16*c* of the cable holding portion 16, the cable 30 is prevented from being disconnected from the holder unit 100.

(4) Receptacle Connector 50

Figure 4A:
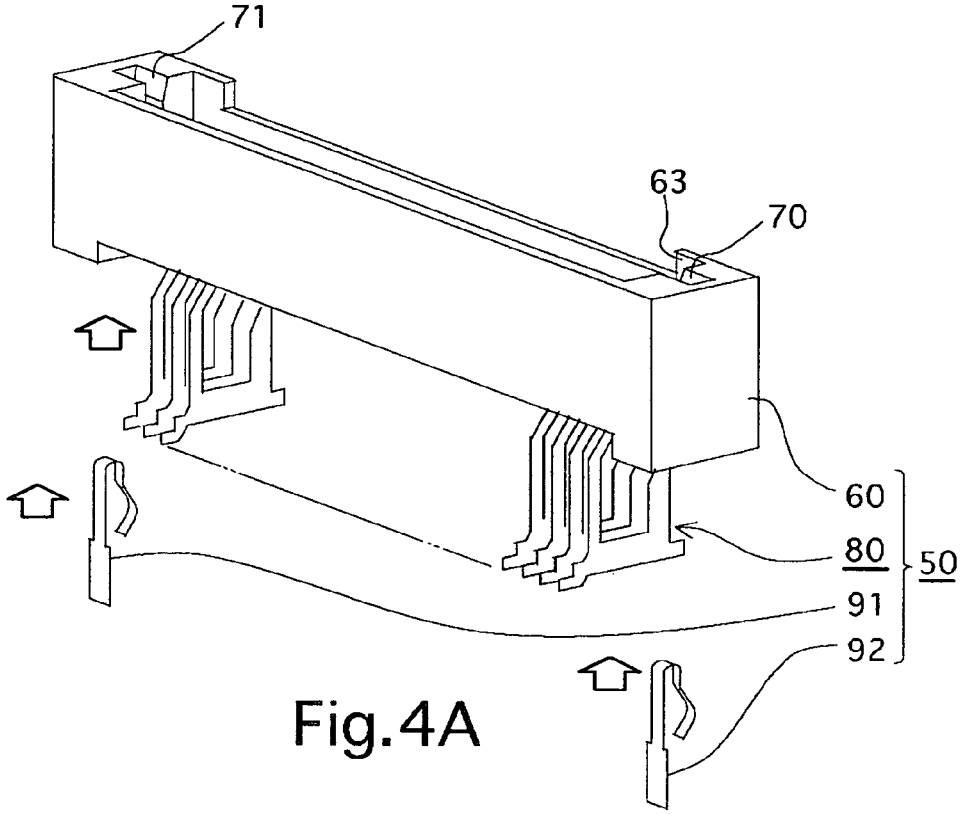
FIG. 4A is an exploded perspective view illustrating the configuration of a receptacle connector according to the embodiment of the present invention.
Figure 4B:
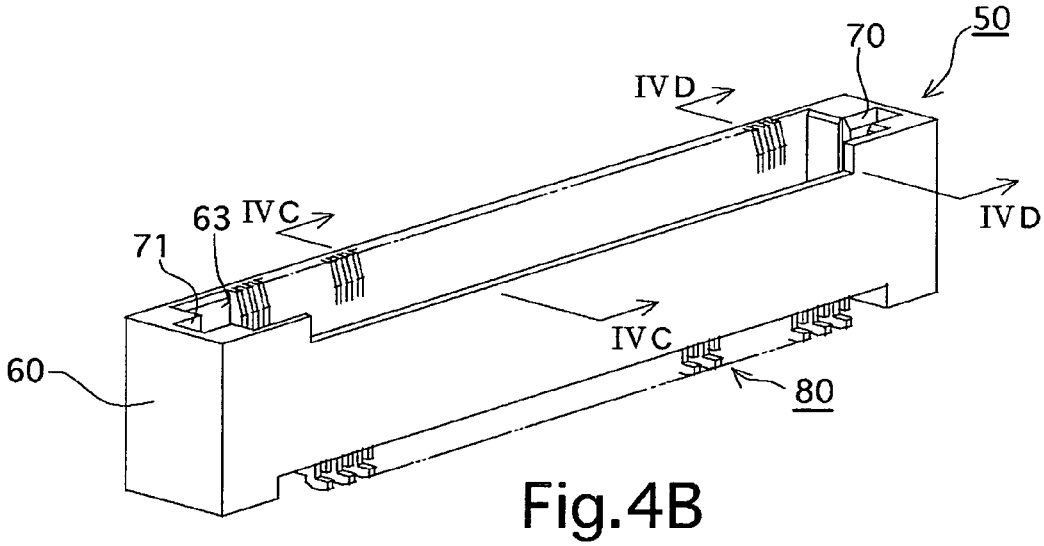
FIG. 4B is a perspective view illustrating the configuration of the receptacle connector after assembly.
Figure 4C:
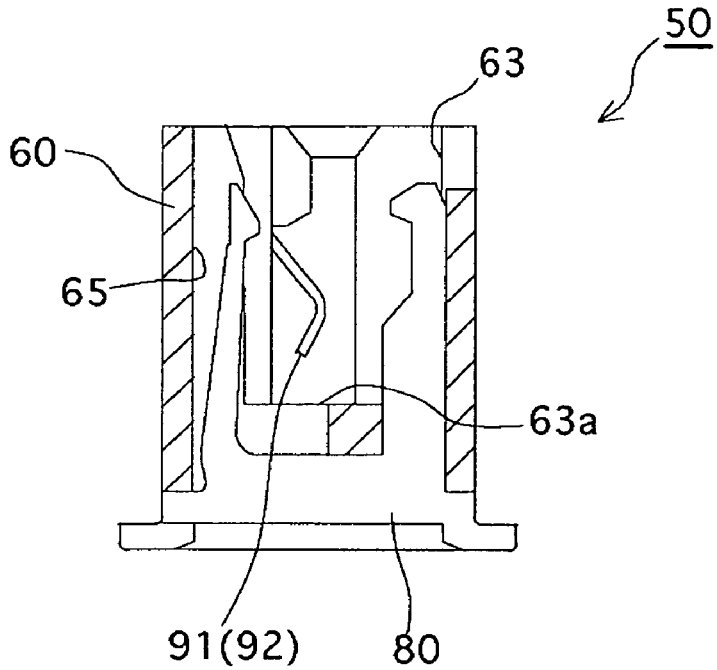
FIG. 4C is a cross-sectional view taken along the line IVC-IVC in FIG. 4B.
Figure 4D:
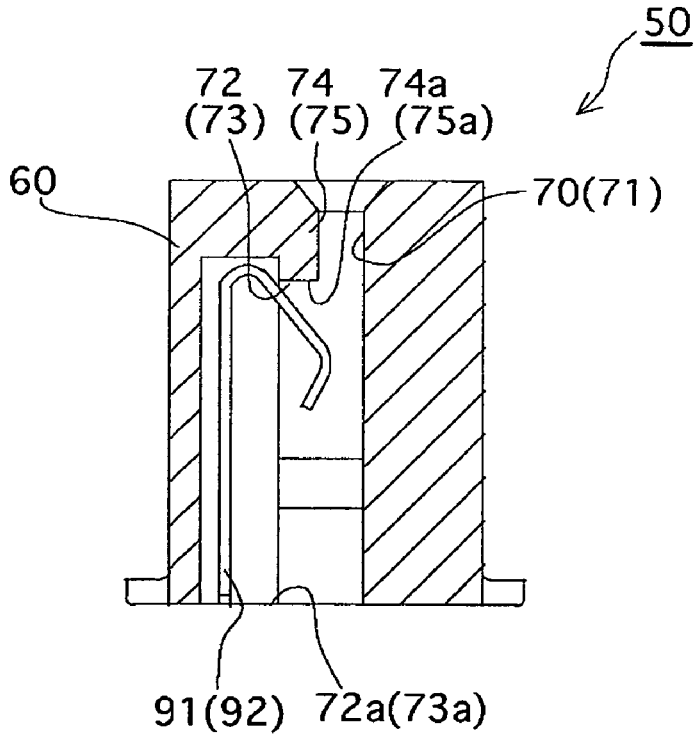
FIG. 4D is a cross-sectional view taken along the line IVD-IVD in FIG. 4B.

As shown in FIGS. 4A and 4B, the receptacle connector 50 is constructed by placing the contacts 80 and the auxiliary springs 91 and 92 inside the receptacle body 60.

The receptacle body (an insulator) 60 is a hollow insulating member which has an approximately rectangular parallelepiped outer shape and into which the holder 10 holding the cable 30 is inserted. The receptacle body 60 has an opening 63, a core hole 65, key insertion portions 70 and 71, key accommodating portions 72 and 73, and stoppers (accommodation maintaining portions 74 and 75. Note that the fitting keys 20 and 21, the key accommodating portions 72 and 73, and the stoppers 74 and 75 constitute a movement restricting device/portion. Likewise with the holder 10, the receptacle body 60 is formed by injection molding an insulating material (such as 9T nylon, 66 nylon, 46 nylon, other nylon (PA), a liquid crystal polymer (LCP), or polyphenylene sulfide (PPS)).

The opening 63 is an opening provided in the upper portion of the receptacle body 60 along the lengthwise direction, and guides the holder unit 100 into the receptacle connector 50. Below the opening 63, a core hole 65 is formed which serves as space for inserting and placing the contacts 80.

The key insertion portions 70 and 71 are formed in the respective two lengthwise end portions of the receptacle body 60 so as to be connected to the opening 63. The key insertion portions 70 and 71 serve as space for guiding the fitting keys 20 and 21 of the holder 10 into the receptacle connector 50 when the holder unit 100 is inserted into the receptacle connector 50.

The key accommodating portions (recessed accommodating portions/movement restricting portions) 72 and 73 are formed in the key insertion portions 70 and 71, respectively, so as to be connected thereto. Each of the key accommodating portions 72 and 73 defines a space extending to one side in the thickness direction (the horizontal direction in FIG. 4C) of the receptacle body 60. The auxiliary springs 91 and 92 are inserted and locked into the key accommodating portions 72 and 73, respectively, and body portions 910 and 920 are fixed at respective predetermined positions in the receptacle body 60.

The stoppers 74 and 75 are provided in the upper portion of the key accommodating portions 72 and 73, respectively. The fit of the holder unit 100 (the cable 30) into the receptacle connector 50 is completed by operating the actuator 40. As shown in FIG. 7C, upper surfaces 20*a* and 21*a* of the respective fitting keys 20 and 21 of the holder 10 are opposed to lower surfaces 74*a* and 75*a* of the respective stoppers 74 and 75, respectively, when the holder unit 100 is connected into the receptacle connector 50, so that the upper surfaces 20*a* and 21*a* can abut against the respective lower surfaces 74*a* and 75*a* when an external force is applied to the cable 30 in a disconnecting direction. In other words, these upper surfaces 20*a* and 21*a* overlap the respective lower surfaces 74*a* and 75*a*, as viewed from the insertion direction of the holder unit 100. In this manner, the holder unit 100 can be prevented from being disconnected from the receptacle connector 50. Furthermore, the insertion depth in which the fitting keys 20 and 21 are inserted into the key accommodating portions 72 and 73, respectively, of the receptacle connector 50 of the holder unit 100 can be determined in accordance with the adjustment of the relative height of the fitting keys 20 and 21 and the respective lower surfaces 74*a* and 75*a*. The final insertion depth is determined by the abutment of the entire bottom surface 63*a* in the opening 63 of the receptacle body 60 on the entire bottom surface 116 of the holder 10. Accordingly, by allowing the bottom surface 63*a* to abut on the bottom surface 116 over a large area, the holder unit 100 can be prevented from tilting inside the receptacle body 60.

The height (the predetermined position) of the lower surfaces 74*a* and 75*a* may be set such that the fitting keys 20 and 21 are inserted into the key accommodating portions 72 and 73, respectively, only after completion of the fit between the holder unit 100 and the receptacle connector 50. In this case, the holder unit 100 and the receptacle connector 50 can be constructed so that, after completion of the fit, the fit of the holder unit 100 is maintained by the abutment of the upper surfaces 20*a* and 21*a* on the lower surfaces 74*a* and 75*a*, respectively. In addition, in the above construction, the fit is not maintained if the fit is not completed, and thus the holder unit 100 can be easily disconnected from the receptacle connector 50. Furthermore, by suitably adjusting the shape of the fitting keys 20 and 21 and the position of the key insertion portions 70 and 71, the holder unit 100 can be prevented from being inversely fitted (incorrectly fitted) into the receptacle connector 50.

Figure 5A:
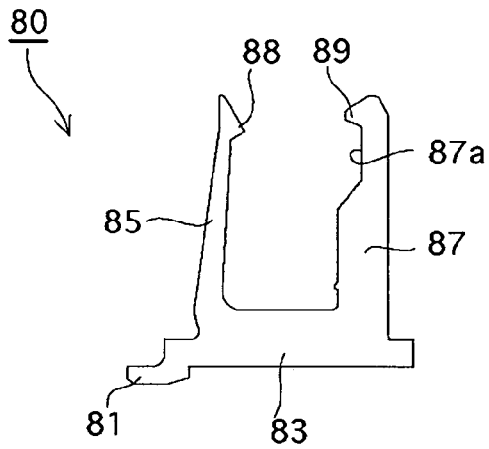
FIGS. 5A and 5B are side views illustrating the configuration of contacts according to the embodiment of the present invention.
Figure 5B:
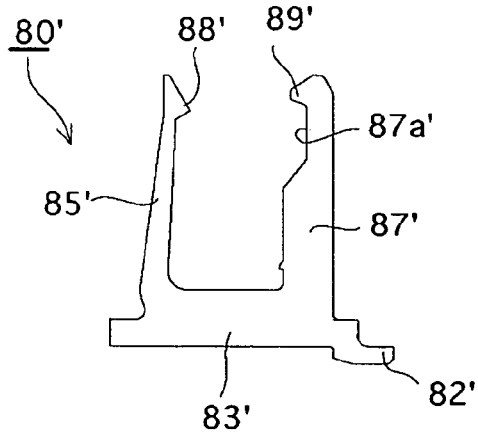

The contacts 80 and 80' each are a plate-like member having a side shape as shown in FIGS. 5A and 5B, and are alternately arranged along the thickness direction thereof. The contacts 80 and 80' have tail portions 81 and 82', connecting portions 83 and 83', spring portions 85 and 85', stabilizer legs 87 and 87', contacting portions 88 and 88', and rotation supporting portions 89 and 89', respectively. The contacts 80 and 80' are made of a copper alloy such as phosphor bronze (a Cu—Sn based copper alloy), beryllium copper (a Cu—Be based copper alloy), titanium copper (a Cu—Ti based copper alloy), a Corson copper alloy (a Cu—Ni—Si based copper alloy), or other copper alloys. The alloy is subjected to stamp molding by use of progressive dies, and the surface of the stamp-molded product is plated with, for example, gold, copper-tin, or tin-lead. The contacts 80 and 80' are mounted on a substrate by a mounting machine by suction or chucking.

In the contact 80, the spring portion 85 and the stabilizer leg 87, which are opposed to each other, extend vertically upward from respective two end portions of the connecting portion 83 which is arranged approximately horizontally on the bottom portion of the core hole 65. In addition, the tail portion 81 extends from a portion which connects the connecting portion 83 with the spring portion 85 and is to be soldered onto a substrate on which the receptacle connector 50 is mounted. The spring portion 85 functions as a spring having the contacting portion 88 which is formed at the end thereof and projects toward the stabilizer leg 87. By allowing the contacting portion 88 to contact a conductor portion of the cable 30, electrical continuity of the connector can be achieved. In the stabilizer leg 87, a rotation supporting portion 89 is formed which rotatably supports the recessed portion 434 of the actuator 40 when the holder unit 100 is inserted into the receptacle connector 50 (see FIG. 7C).

The contact 80' includes the connecting portion 83', the spring portion 85', the stabilizer leg 87', the contacting portion 88', and the rotation supporting portion 89', each of which has the same shape as that of the connecting portion 83, the spring portion 85, the stabilizer leg 87, the contacting portion 88, and the rotation supporting portion 89 of the contact 80. In the contact 80', instead of the tail portion 81 of the contact 80, the tail portion 82' extends from a portion connecting the connecting portion 83' with the stabilizer leg 87' and is soldered onto a substrate on which the receptacle connector 50 is mounted. When the contacts 80 and 80' having the above configurations are arranged in parallel so that the portions having the same shape are aligned with each other, the tail portions 81 and 82' are alternately arranged (FIGS. 7A through 8B).

Figure 5C:
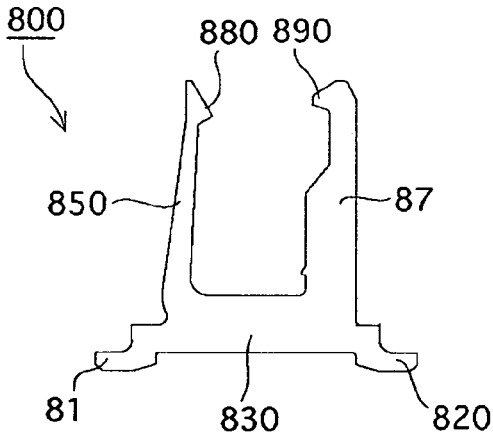
FIG. 5C is a perspective view illustrating the configuration of a contact according to a modified example.

Furthermore, instead of the contacts 80 and 80', a type of contacts 800 shown in FIG. 5C may be arranged in parallel. The contact 800 has a connecting portion 830, a spring portion 850, a stabilizer leg 870, a contacting portion 880, and a rotation supporting portion 890, each of which has the same shape as that of the connecting portion 83, the spring portion 85, the stabilizer leg 87, the contacting portion 88, and the rotation supporting portion 89, respectively, of the contact 80, and tail portions 810 and 820 are provided so as to extend from the respective two end portion of the connecting portion 830.

The auxiliary springs (spacing members) 91 and 92 are made of an alloy such as phosphor bronze (a Cu—Sn based copper alloy), beryllium copper (a Cu—Be based copper alloy), titanium copper (a Cu—Ti based copper alloy), a Corson copper alloy (a Cu—Ni—Si based copper alloy), or other copper alloy, or can be made of stainless steel (SUS). The alloy is subjected to stamp molding by use of progressive dies, and the surface of the stamp-molded product is plated with, for example, gold, copper-tin, or tin-lead to produce a plate-like member.

Figure 6:
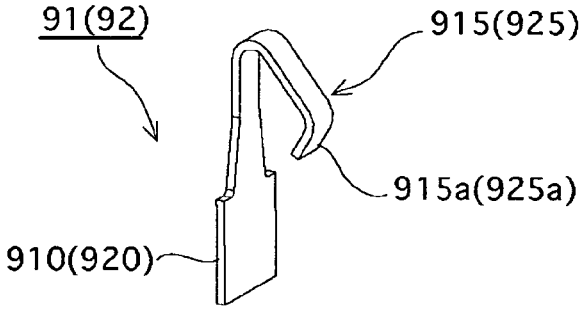
FIG. 6 is a perspective view illustrating the configuration of an auxiliary spring according to the embodiment of the present invention.

A pair of plate-like members are bend to form the auxiliary springs 91 and 92 having spring portions 915 and 925 and the body portions 910 and 920, respectively, as shown in FIG. 6. The auxiliary springs 91 and 92 are fixedly engaged at respective predetermined positions in the receptacle body 60. The spring portions 915 and 925 each have a shape which extends in the direction away from the body portions 910 and 920 and is bent at the bent abutment portions 915*a* and 925*a* to approach the body portions 910 and 920. In a free state in which a force is not applied to the auxiliary springs 91 and 92, at least the bent abutment portions 915*a* and 925*a* of the spring portions 915 and 925 project from the key accommodating portions 72 and 73 so as to be positioned in the key insertion portions 70 and 71, respectively. When a force is exerted on the spring portions 915 and 925 in a direction from the key insertion portions 70 and 71 to the key accommodating portions 72 and 73, the spring portions 915 and 925 can elastically deform so as to approach the body portions 910 and 920, respectively. If this force is released, the original shape is resumed due to the elasticity.

The auxiliary springs 91 and 92 can either be compression springs or tension springs. Moreover, instead of the auxiliary springs 91 and 92, rubber members having elasticity may be employed. For example, one end of the rubber members may be fixed on the side wall of the key accommodating portions 72 and 73, and the other end may be allowed to project from the key accommodating portions 72 and 73 so as to be positioned in the key insertion portions 70 and 71, respectively. In this case, when a force is exerted on the rubber member in a direction from the key insertion portions 70 and 71 to the key accommodating portions 72 and 73, the rubber member can deform so as to approach the body portions 910 and 920. If this force is released, the original shape of the rubber member is resumed due to the elasticity.

The assembly of the receptacle connector 50 is performed by an assembly method the same as those of a well-known connector. The type of the connector may be either of an ST type, in which the extending direction of a cable is perpendicular to a substrate, and a RA type, in which the extending direction of a cable is parallel to a substrate.

It is desirable for the tail portions 81 and 82 to be alternately arranged. Accordingly, since the pitch distance of the tail portions 81 and 82 on one side is twice the pitch distance of the contacts 80, the mounting ability of the contacts 80 onto a substrate can be improved, and is effective for preventing the connector from falling off the substrate when an accidental external force is applied to the cable 30 or the connector.

(5) Insertion-removal Action of the Holder Unit 100 (the Cable 30) into/from the Receptacle Connector 50

Figure 7A:
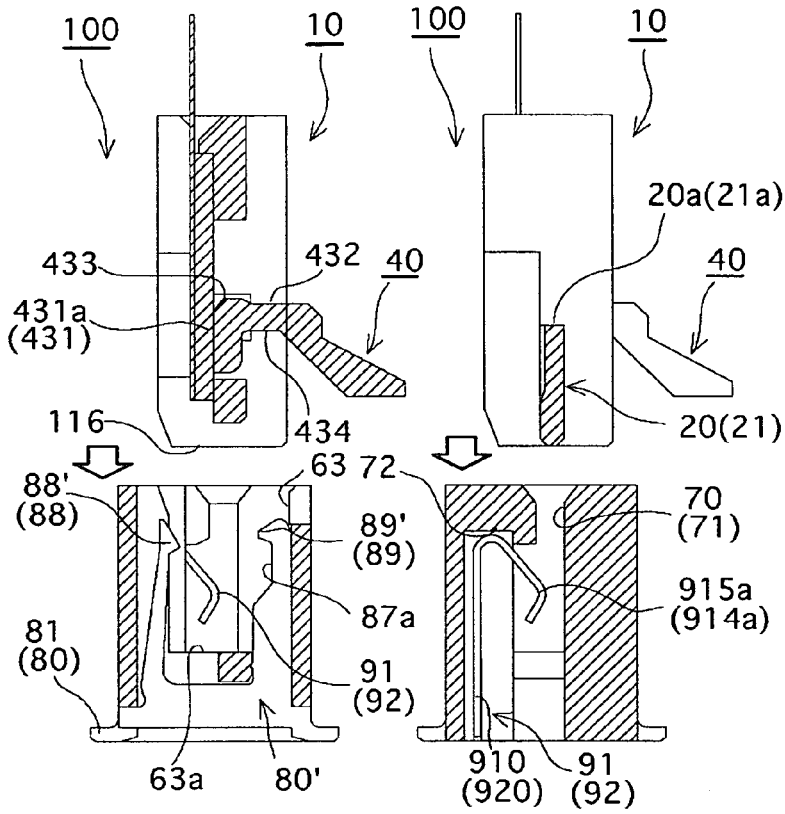
FIG. 7A shows the state before the holder unit of the present invention is inserted into the receptacle connector.
Figure 7B:
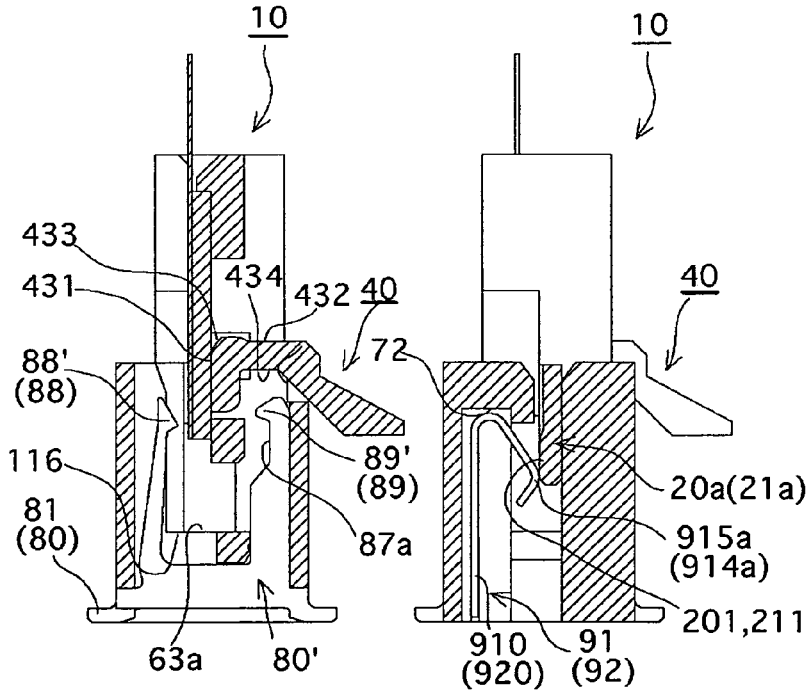
FIG. 7B shows the state at the initial stage of insertion of holder unit into the receptacle connector.
Figure 7C:
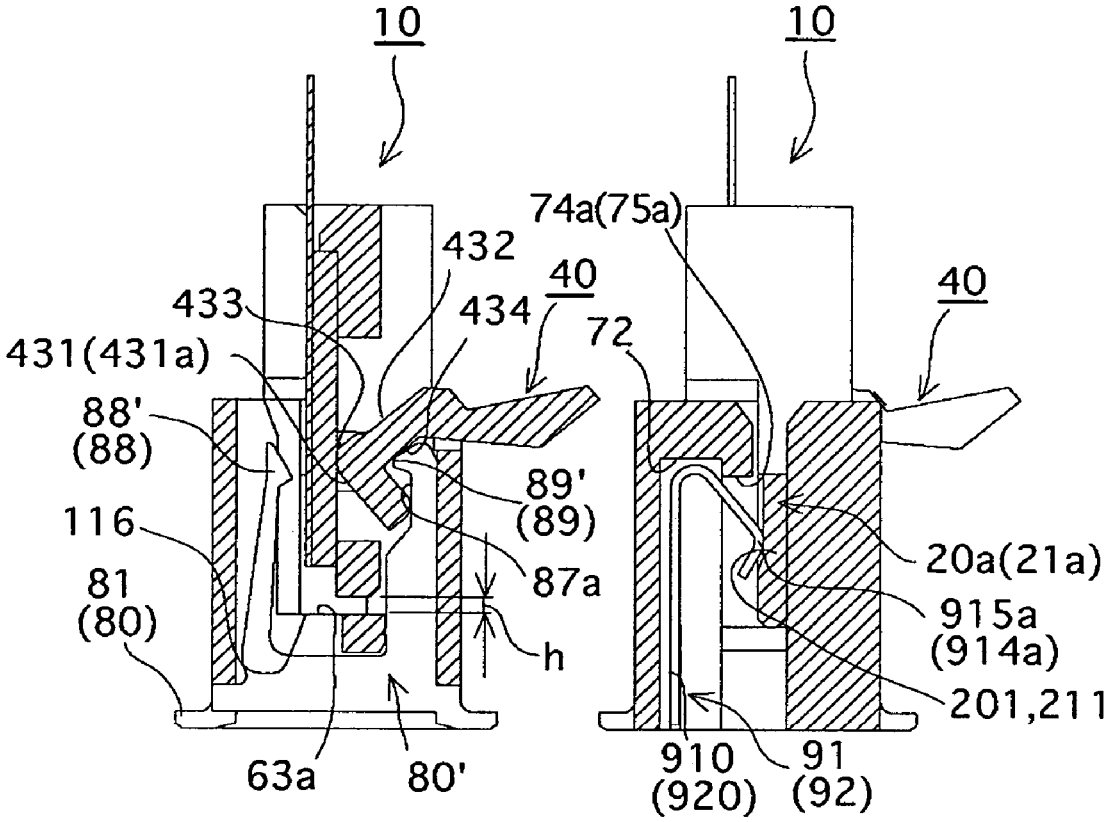
FIG. 7C shows the state in which the holder unit is temporarily held.

First, the holder unit 100 is inserted into the receptacle connector 50 so that the fitting keys 20 and 21 of the holder 10 enter into the key insertion portions 70 and 71 (the state shown in FIG. 7B changed from the state shown in FIG. 7A). At this time, if an attempt is made to move the holder unit 100 such that the cable 30 approaches the contacting portion 88, the movement of the holder unit 100 is restricted so that the fitting keys 20 and 21 abut against the key insertion portions 70 and 71, respectively, or the stoppers 74 and 75, respectively. Furthermore, since a force is applied to the fitting keys 20 and 21 by the auxiliary springs 91 and 92, respectively, in a direction in which the holder unit 100 is moved away from the contacting portion 88, the cable 30 does not contact the contacting portion 88.

When the holder unit 100 is inserted further (deeper) into the receptacle connector 50, the recessed portion 434 of the actuator 40 abuts against the rotation supporting portion 89, whereby the actuator 40 starts to rotate (FIG. 7C). The free rotation of the actuator 40 in this state does not produce a load which would be applied to the cable 30 such that the cable 30 is moved toward the contacting portion 88. When the upper surfaces 20*a* and 21*a* of the fitting keys 20 and 21 are moved to a position lower than the lower surfaces 74*a* and 75*a* of the stoppers 74 and 75, respectively, the bent abutment portions 915*a* and 925*a* abut against the fitting keys 20 and 21 due to the elasticity of the auxiliary springs 91 and 92. Furthermore, when the upper surfaces 20*a* and 21*a* reach a position which is lower than the lower surfaces 74*a* and 75*a*, since the bent abutment portions 915*a* and 925*a* pass the step portions 201 and 211, a click can be felt. At this time, the end portion of the rotation supporting portion 89 abuts against the recessed portion 434 of the actuator 40, and the end portion of the stabilizer portion 431 abuts against the inner surface 87*a* of the stabilizer leg 87. Furthermore, the cam portion 43 abuts against the reinforcing plate 36. Thus, a temporary holding state is obtained in which the holder unit 100 is prevented from being disconnected.

Figure 8A:
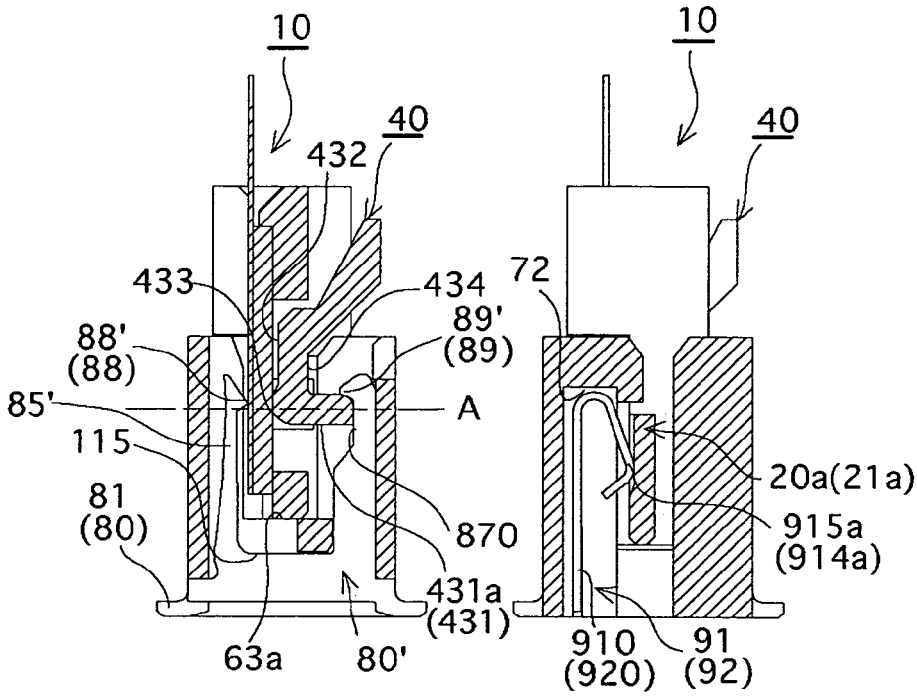
FIG. 8A shows the state in which the actuator according to the embodiment of the present invention is closed to fit and lock the holder unit.
Figure 8B:
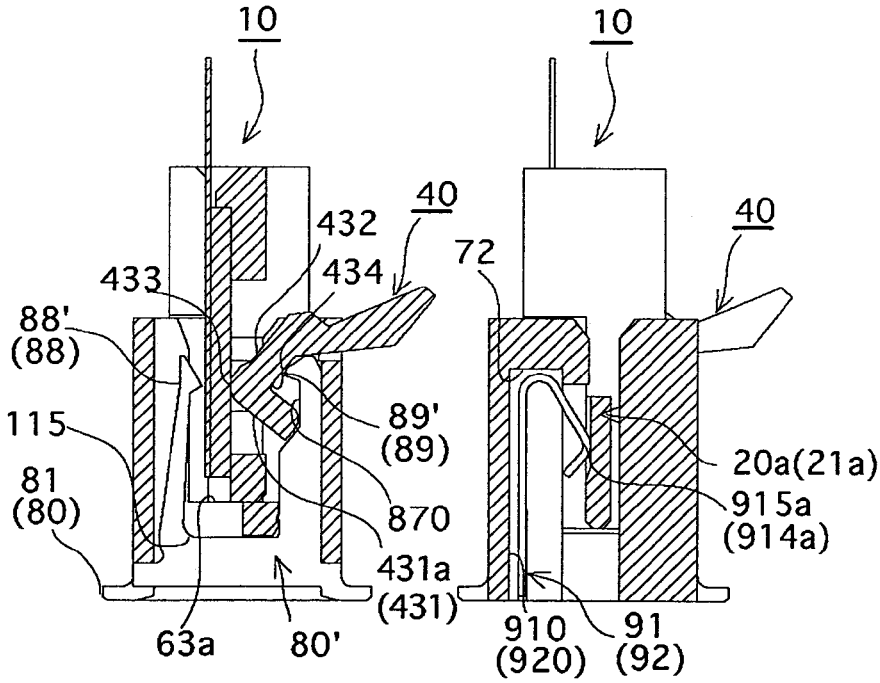
FIG. 8B shows the state in which the lock is released by opening the actuator.

Subsequently, the actuator 40 is operated to a closed position. Specifically, the actuator 40 is rotationally moved (rotationally moved in the counter clockwise direction as shown in FIG. 8A) until the planar connection portion 432 is aligned along the vertical direction (see FIG. 8A) and becomes parallel to the cable 30, while the cam portion 43 slides on the reinforcing plate 36 and the stabilizer leg 87, and is rotationally moved until the stabilizer portion 431 is positioned horizontally. During this movement, the cable 30 is moved together with the holder 10 in a direction in which the cable 30 is pressed against the contacting portion 88 by the rotational movement of the planar connection portion 432 and the stabilizer portion 431. At the closed position of the actuator 40 where the end surface 431*b* of the stabilizer portion 431 abuts against the vertically extending recessed portions 87*a* and 87*a*' provided in the stabilizer legs 87 and 87', respectively, and the stabilizer portion 431 is positioned horizontally (as shown in FIG. 8A), the contacting portion 88, the cable 30, the stabilizer portion 431, and the stabilizer leg 87 are aligned in a straight line (line of force A shown in FIG. 8A). Specifically, by setting the distance between the end surface 431*b* and the receiving surface 431*c* to a suitable constant value D1 (FIG. 3B), the contact pressure generated by the spring portion 85 of the contact 80 and the spring portion 85' of the contact 80' can be received by the stabilizer leg 87 and 87' without causing unnecessary movement. Therefore, stable electrical contact can be obtained. Moreover, since the auxiliary springs 91 and 92 deform by a predetermined amount to generate a pressing force thereby, and due to the occurrence of the line of force A, as shown in FIG. 8A, a mechanically stable state is obtained. Therefore, the position of the holder 10 is stabilized, and unnecessary movement is avoided. In this manner, a lock state can be obtained in which the conduction portion of the contacting portion 88 is brought into contact with the conduction portion of the cable 30 to establish electrical continuity.

Furthermore, by shifting the actuator 40 to the closed position, the holder unit 100 is moved vertically downward by an amount h (see FIG. 7C). Hence, during the period from when the user starts to operate the actuator 40 until the completion of the locked state (closed state) thereof, the contacting portion 88 slides on the cable 30. Therefore, a wiping effect such as removal of an oxide layer on the cable 30 can be obtained.

When the actuator 40 is operated in an open direction (rotationally moved in the clockwise direction in FIG. 8B), the holder unit 100 is automatically moved horizontally so that the cable 30 is separated from the contacting portion 88. This movement is caused by the contact pressure on the cable 30 from the contacts 80 and the pressing pressure on the fitting keys 20 and 21 from the auxiliary springs 91 and 92. Hence, an electrically disconnected state between the cable 30 and the contacting portion 88 is obtained.

Furthermore, since the auxiliary springs 91 and 92 temporarily hold the holder unit 100, the holder unit can be prevented from disconnecting spontaneously.

The present invention has been described with reference to the above embodiment, but the invention is not limited to the embodiment. Improvements or modifications may be made within the purposes of the improvements or the spirit of the invention.

What is claimed is:

1. A cable connector having a receptacle connector, said receptacle connector comprising:

a receptacle body which is made of an insulating material and into which a cable is inserted;

a plurality of contacts which are provided in said receptacle body;

a spacing member which separates said cable inserted into said receptacle body from said contacts by an elastic force of said spacing member to thereby provide an electrically disconnected state; and a biasing member which biases said cable toward said contacts against an elastic force of said spacing member, a movement restricting portion which restricts said movement of said cable toward said contacts so that said cable is brought into conductive contact with said contacts by said biasing force of said biasing member only when said cable is inserted to said predetermined position in said receptacle body.

2. The cable connector according to claim 1, wherein said cable connector further comprises a holder for holding said cable when said cable is inserted into said receptacle body.

3. The cable connector according to claim 2, wherein said biasing member comprises an actuator which is rotatably held by said holder;

wherein said actuator includes a cam portion which is rotatably movable when said holder is inserted into said receptacle body; and wherein said actuator biases said cable toward said contacts by the rotational movement of said cam portion against said elastic force of said spacing member.

4. The cable connector according to claim 1, wherein said spacing member comprises a spring which is supported by said receptacle body so as to be elastically deformable in a direction in which said cable, inserted into the receptacle body, opposes said contacts, wherein said spacing member separates said cable from said contacts by said elastic force of said spacing member when said biasing force of said biasing member is not exerted on said cable.

5. The cable connector according to claim 2, wherein said cable connector comprises a movement restricting device including said movement restricting portion provided on said receptacle body and a projecting portion provided on said holder so as to project outward from a side surface thereof;

wherein said movement restricting portion comprises:

a recessed accommodating portion which accommodates said projecting portion therein by said biasing force of said biasing member when said cable is inserted to said predetermined position in said receptacle body whereby said cable is brought into contact with said contacts; and an accommodation maintaining portion which maintains a state in which said projecting portion is accommodated in said recessed accommodating portion.

6. The cable connector according to claim 5, wherein said biasing member comprises an actuator which is rotatably held by said holder;

wherein said actuator includes a cam portion which is rotatably movable when said holder is inserted into said receptacle body;

wherein said actuator biases said cable toward said contacts by the rotational movement of said cam portion against said elastic force of said spacing member;

wherein, upon said cam portion of said actuator being rotationally moved in a direction so as to bias said cable toward a contacting portion in a state where said cam portion is positioned between said contacting portion of said contacts and a stabilizer leg, which are arranged so as to be opposed to each other, said accommodation maintaining portion maintains a state in which said projecting portion is accommodated in said recessed accommodating portion by bringing two opposing end surfaces of a planar portion provided in said cam portion into abutment with the rear surface of said cable and said stabilizer leg, respectively, to thereby align said contacting portion, abutment surfaces of said cable, said planar portion, and an abutment surface of said stabilizer leg in one line of force.

* * * * *